United States Patent [19]

Stairs, Jr.

[11] Patent Number: 4,924,533

[45] Date of Patent: May 15, 1990

[54] COUPLING MEANS FOR TOILET TANK AND BOWL ASSEMBLY

[75] Inventor: Henry M. Stairs, Jr., Ligonier, Pa.

[73] Assignee: American Standard Inc., New York, N.Y.

[21] Appl. No.: 270,578

[22] Filed: Nov. 14, 1988

[51] Int. Cl.[5] ..... E03D 11/00

[52] U.S. Cl. ..... 4/252 R; 4/417; 277/212 R; 411/182; 411/60; 411/408; 411/399

[58] Field of Search ..... 4/417, 252 R; 411/41, 411/182, 177, 173, 107, 105, 108, 73, 60, 542, 313, 314, 908, 399; 277/212 R, 212 C

[56] References Cited

U.S. PATENT DOCUMENTS

| | | | |
|---|---|---|---|
| 1,895,145 | 1/1933 | Brotz | 4/417 |
| 1,996,128 | 4/1935 | Thomson | 411/107 |
| 2,096,307 | 10/1937 | Pieslak | 4/417 |
| 2,956,468 | 10/1960 | Macy | 411/41 |
| 3,272,952 | 9/1966 | McKeon | 411/542 |
| 3,299,766 | 1/1967 | Gould et al. | 411/542 |
| 4,208,944 | 6/1980 | Moryl | 411/182 |
| 4,276,806 | 7/1987 | Morel | 411/41 |
| 4,391,559 | 7/1983 | Mizusawa | 411/41 |
| 4,648,766 | 3/1987 | Wollar | 411/41 |
| 4,715,756 | 12/1987 | Danico et al. | 411/542 |
| 4,757,560 | 7/1988 | Grimstad | 4/417 |

FOREIGN PATENT DOCUMENTS

| | | | |
|---|---|---|---|
| 971087 | 7/1975 | Canada | 411/177 |
| 655442 | 12/1937 | Fed. Rep. of Germany | 4/417 |
| 1347776 | 11/1963 | France | 4/417 |
| 922817 | 4/1963 | United Kingdom | 4/417 |

*Primary Examiner*—Henry J. Recla
*Assistant Examiner*—Edward C. Donovan
*Attorney, Agent, or Firm*—John P. Sinnott

[57] ABSTRACT

A mounting assembly to couple a water tank to a water closet is disclosed. The mounting assembly includes a threaded bolt, tubular elastomeric seal member and fastening means. The elastomeric member has centering ribs formed around its outer surface, a flanged head at one end and the other end is bifurcated. When the bolt is inserted therethrough, the elastomeric member expands in the tank mounting opening and the bifurcated end diverges to form a pair of latching tabs to prevent removal of the elastomeric seal member and bolt from the tank mounting opening.

2 Claims, 5 Drawing Sheets

COUPLING MEANS FOR TOILET TANK AND BOWL ASSEMBLY

BACKGROUND OF THE DISCLOSURE

1. FIELD OF THE INVENTION

This invention relates to a combination seal means and bolt assembly for sanitary installations and, more particularly, to a means for rapidly coupling together a water tank and water closet in a watertight seal.

2. DESCRIPTION OF PRIOR ART

Assemblies used to couple a water tank to a water closet that are in general use employ mounting bolts, washers, rubber parts to effect a seal, and nuts to threadedly engage the bolts to complete the assembly. Each water closet includes in its bottom wall, a large central discharge opening which passes water from the tank into the water closet, and tank mounting passages, generally 2 or 3, which are positioned around the central discharge opening. These passages house the bolt and seal assembly that couples the water tank to the water closet. U.S. Pat. No. 4,757,560 of Kohler Co. describes a unitary rubber plate, generally in the form of an equilateral triangle with integrally formed hard rubber studs at each apex of the triangle. Each stud has a central opening so that a tank mounting bolt is housed therein. Also, each stud has an integrally formed spacer or bumper to maintain a space between the base of the tank and the deck of the water closet. The central area of the triangular plate is open and is encircled by an upstanding flange which corresponds, in size, to the central discharge opening of the tank. When in place, a tank-to-water closet seal is formed by the upstanding flange. The rubber studs fit into corresponding openings in the tank. When the tank is placed in position, the open central area fits around the corresponding water inlet opening of the water closet, and the spacers rest on the top surface of the water closet. The threaded end of each bolt passes through corresponding openings in the deck of the water closet. The tank is mounted in position by three wing nuts which draw the tank toward the bowl to provide a watertight seal. Care is required when tightening the bolts so that the tank maintains its level after assembly.

Another tank-to-water closet coupling assembly, in general use by American Standard Inc. prior to this invention, comprises a pair of flat rubber grommets with threaded mounting bolts and nuts, a close-coupling gasket and a horseshoe-shaped spacer. When the tank is to be mounted to the water closet, the horseshoe spacer is positioned around the water inlet opening on the deck of the water closet with the close-coupling gasket positioned in the inlet opening. The flat rubber grommet is assembled with the mounting bolt, and the bolt is passed through complimentary openings in the tank and water closet. Finally, the hex nuts are tightened on each bolt to complete the assembly of the tank and water closet.

SUMMARY OF THE INVENTION

It is an object of the present invention to provide a specially designed rubber seal means which is inserted into the tank mounting hole, and then the mounting bolt is telescopically received in the rubber seal means, preventing its accidental removal from the tank.

Another object of the invention is to provide a china-to-china, water tank-to-water closet assembly in which the tank maintains its parallelism with respect to the deck of the water closet and does not require a flat disc-like spacer to separate the tank from the water closet.

A further object of the invention is to provide a mounting bolt and seal means assembly which is inexpensive to manufacture, is easily assembled, and which requires no tools or trained workers to effect a tank-to-water closet watertight seal while always achieving a china-to-china assembly which is level.

These and other objects of the invention are achieved by providing a mounting assembly to couple a water tank to a water closet. The assembly includes an elastomeric seal member having a tubular body, one of which is bifurcated, and the other end is formed having a flanged head, the diameter of which is greater than the diameter of the opening formed in the base of the water tank. The tubular body is formed having at least one longitudinal extending rib integrally formed on its external surface and positioned between the flanged head and bifurcated end. A mounting bolt, threaded at one end and flanged head formed at its other end, is telescopically positioned in the axial bore of the tubular body so that its threaded end extends therefrom. The bifurcated end forms a pair of opposing tabs which are adapted to nest against the under surface of the tank adjacent its opening to provide latch means which prevents removal of the bolt and seal member from the tank. A fastening means threadedly engages the threaded end of the bolt when the tank and water closet are coupled together in a watertight sealed engagement.

DETAILED DESCRIPTION OF THE PREFERRED EMBODIMENT

In FIGS. 1–7, coupling means 30 is illustrated, which is used to mount water tank 10 to water closet 14.

Figure 1:
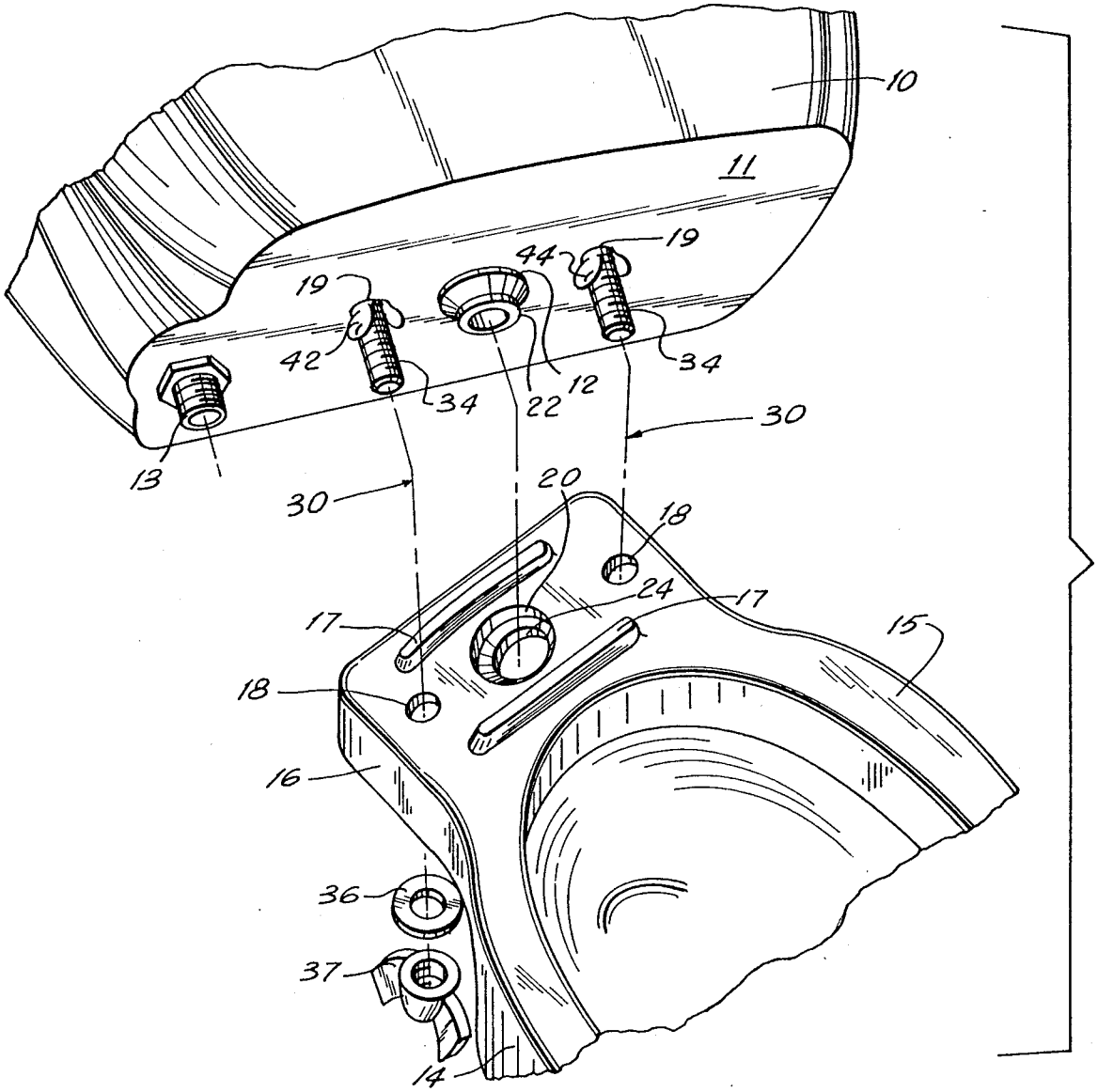
FIG. 1 is a fragmentary exploded view, in perspective, illustrating the water tank and the rear top deck of the water closet prior to assembly of the invention herein.
Figure 2:
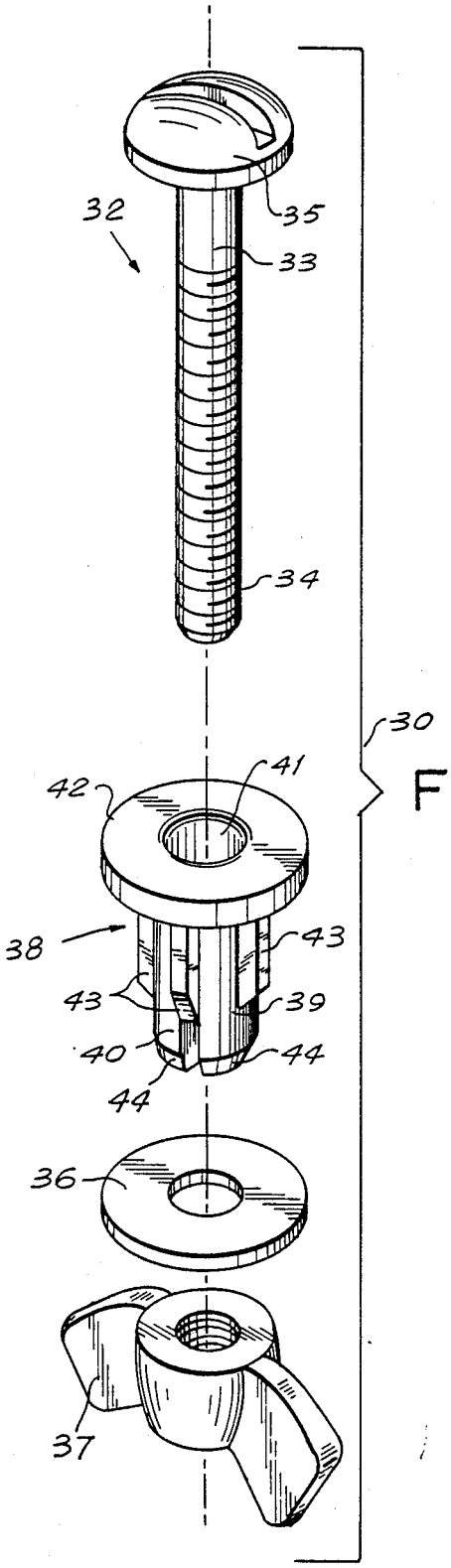
FIG. 2 is an exploded view, in perspective, of a coupling means adapted to assemble water tank to the water closet.
Figure 5A:
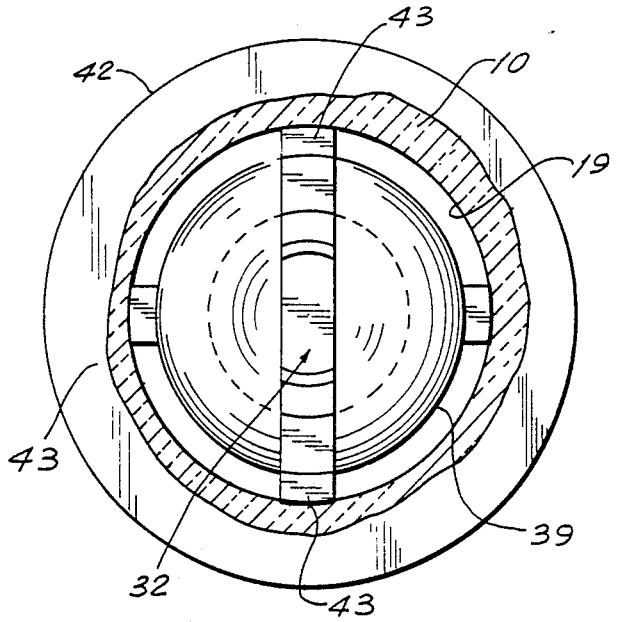
FIGS. 5A and 5B are enlarged bottom views of FIG. 4 showing the bolt prior to and after full insertion through the elastomeric seal member.
Figure 5B:
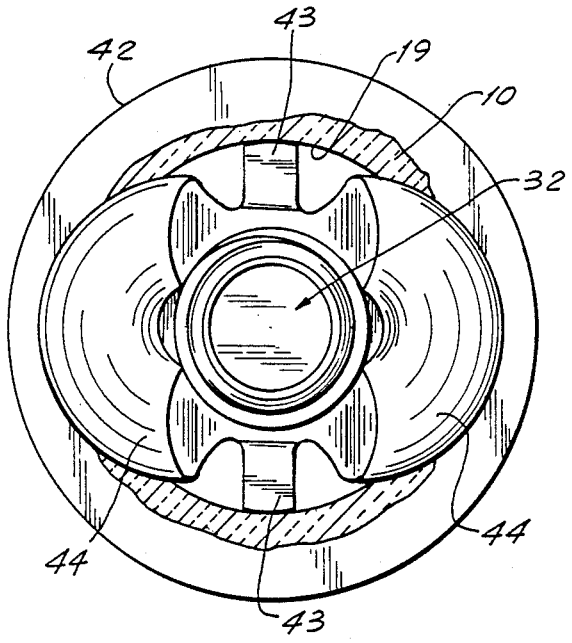

Water closet 14 has a generally flat upper surface 15 and a generally rectangular section 16 formed at the rear of water closet 14. A pair of spaced apart and aligned openings 18 are formed in rectangular section 16 and are aligned with a complimentary pair of openings 19 formed in tank 10, as shown in FIG. 1. Coupling means 30 comprises a bolt 32 and elongated shaft 33, one end 34 of which is threaded and a flanged head 35 formed at its other end. A transverse screw drive slot 36 or equivalent means is provided to grip the bolt when mounting or removing tank 10. An elastomeric anchor 38 having an elongated tubular body 39, one end 40 of which is bifurcated and, at its other end 42, is in the form of a flanged head. A plurality of longitudinally extending centering ribs 43 are formed along the outer surface of tubular body 39 and are equally spaced thereround. Elastomeric anchor 38 is inserted into tank openings 19, and bolt 32 is inserted into elastomeric anchor 30 through its axial bore 41.

Water inlet opening 20 is formed in rectangular section 16 of water closet 14 between openings 18, and is aligned with its complimentary outlet opening 12 which is positioned between tank mounting openings 19. A pair of spaced apart ribs 17 are positioned adjacent inlet opening 20 and provide seating means on which base 11 of tank 10 is placed to form a china-to-china connection between water tank 10 and water closet 14. Water inlet opening 20 has a beveled rim section 24 and is complimentary with beveled section 23 of elastomeric seal ring 22.

Figure 3:
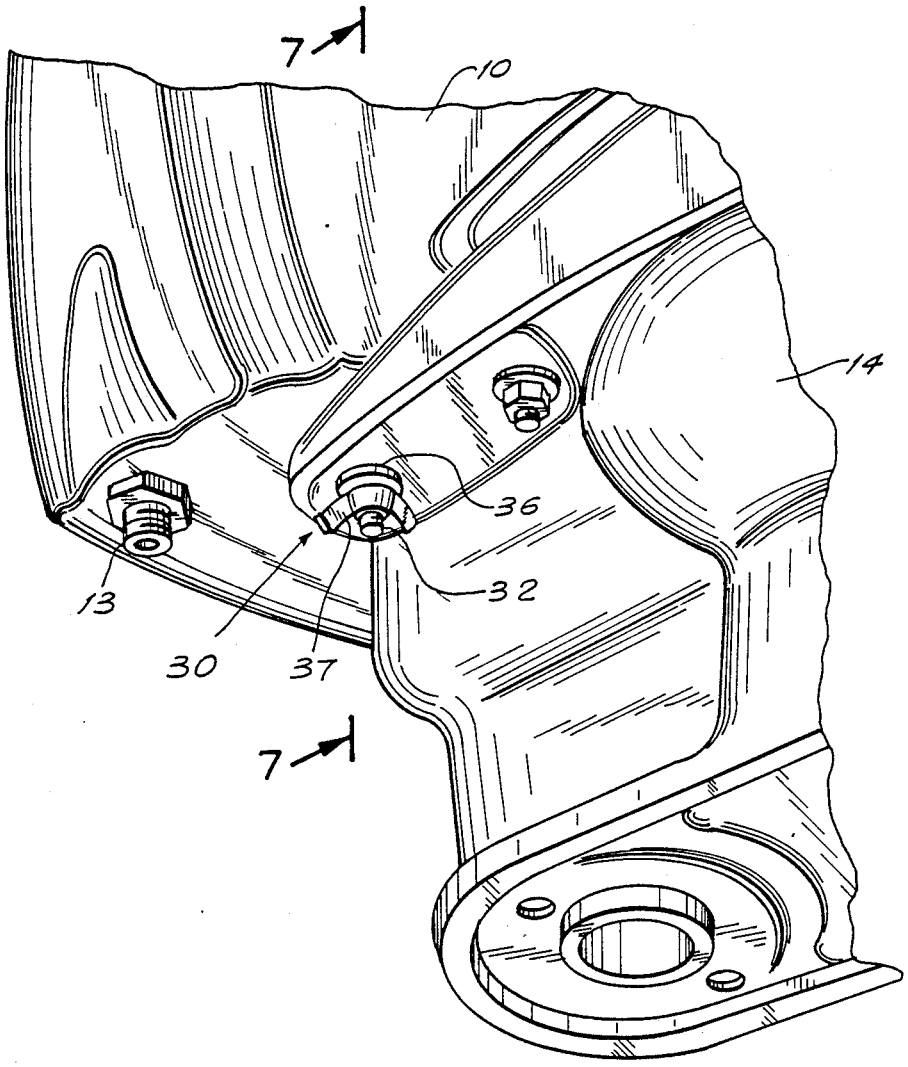
FIG. 3 is a fragmentary view, in perspective, of the water tank and water closet in full assembly, as viewed from the bottom of FIG. 1.
Figure 4:
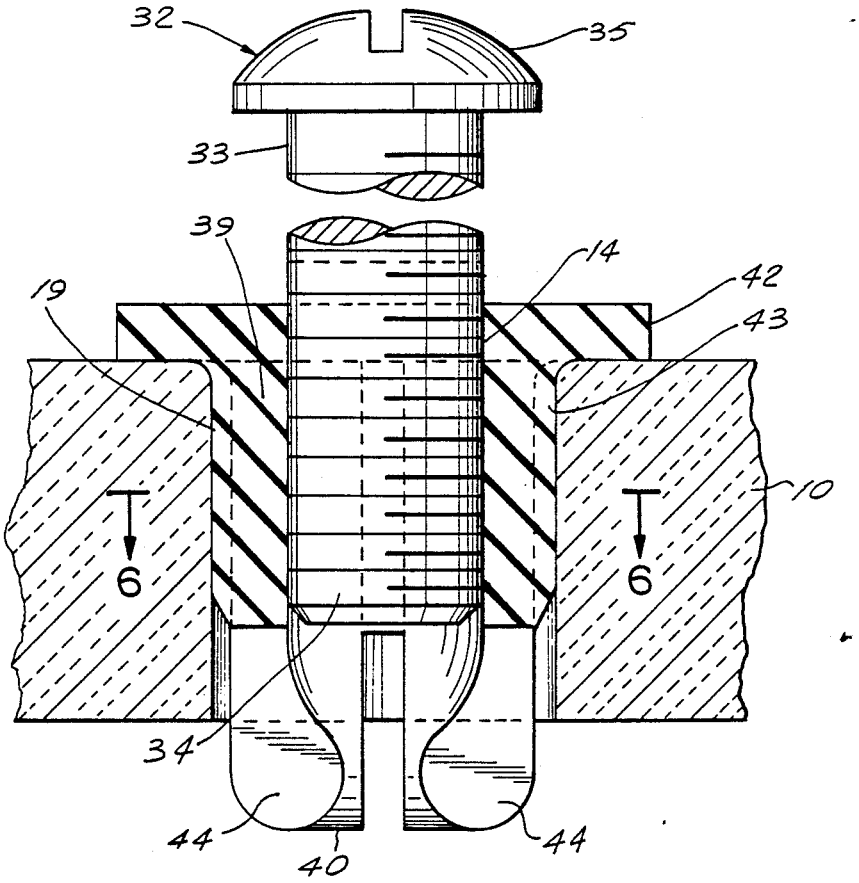
FIG. 4 is an enlarged fragmentary view, in elevation, of the coupling means, in a partial assembly, prior to complete insertion in the elastomeric seal member.
Figure 6:
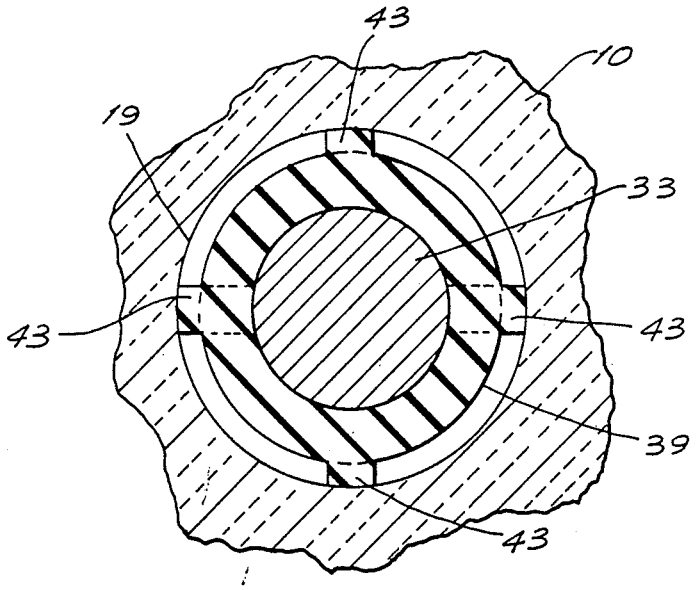
FIG. 6 is a sectional view taken along the line 6—6 of FIG. 4.
Figure 7:
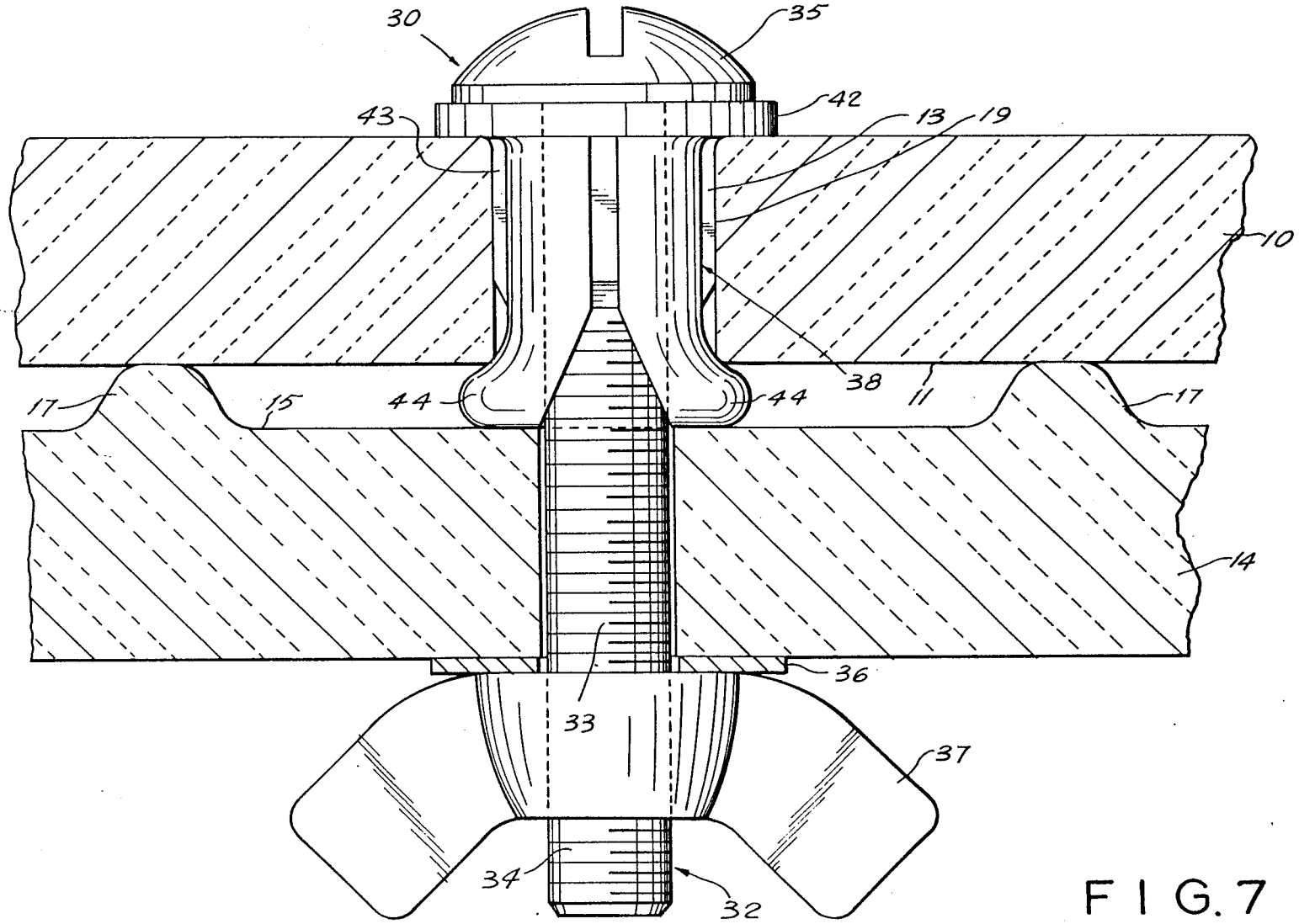
FIG. 7 is an enlarged fragmentary view taken along the line 7—7 of FIG. 3.

In practice, when tank 10 is to be mounted to water closet 16, elastomeric seal ring 22 is positioned on water inlet opening 20 so that complimentary beveled surfaces 23,24 are in mating contact. Coupling means 30 is positioned in openings 19 by first inserting elastomeric anchor 38 therein. Bolt 32 is inserted into axial bore 41 so that threaded end 34 extends beyond anchor 38 and, at the same time, bifurcated end 40 diverges outwardly to form a pair of stops or latches 44 which prevents elastomeric anchor 38 and bolt 32 from being removed from openings 19. Since openings 18 and outlet opening 21 are complimentary and are in alignment with tank mounting openings 19 and outlet openings 21, tank 10 is positioned onto ribs 17 and seal ring 22 of rectangular section 16 of water closet 10 in a china-to-china connection. Elastomeric seal ring 22 is sized so that its axial length is slightly greater than the height of china ribs 44 and will be compressed by tank 10 to form a watertight seal. Tank 10 is secured by washer 36 and wing nut 37 by hand tightening wing nut 37 against the under surface of rectangular section 16, as shown in FIGS. 3 and 7. In FIG. 7, stops 44 extend beyond openings 19 in wall 11 and are in their latched position when tank 10 is resting on china ribs 17, that is, in horizontal alignment with respect to rectangular surface 16 of water closet 14. No shims or other means are required. After tank 10 is positioned, FIG. 3, supply water conduit, not shown, is connected to water inlet 13 of tank 10. In addition, flanged head 42 of elastomeric anchor and bolt head 35 cooperate to form a watertight seal in tank 10 when coupling means 30 is tightened, as shown in FIG. 7.

I claim:

1. A mounting assembly adapted to couple a water tank to a water closet, said assembly comprising:

an elastomeric seal member having a tubular body, one end of which is formed having a flanged head, the diameter of which is greater than the diameter of a tank mounting opening formed in the base of said water tank, and the other end is bifurcated, said bifurcated end portions having slots formed therebetween that extend longitudinally from said associated end to the midportion of said tubular body, said tubular body having an axial passage formed therethrough, and at least one longitudinal extending centering rib integrally formed on its external surface is positioned between said flanged head and one of said bifurcated end slots;

a bolt having an elongated shank which is threaded at one end and a flanged head formed at the other end is telescopically positioned in said passageway of elastomeric member; and fastening means to threadedly connect said threaded end of said bolt when said tank and water closet are coupled together and to press said bifurcated end portions between the water tank and the water closet in order to form lateral stops that prevent said bolt and said seal member from removal from the water tank.

2. The mounting assembly of claim 1 wherein said at least one centering rib is four, equally spaced around the outer surface of said tubular body.

* * * * *